US008864544B2

(12) United States Patent
Anderman et al.

(10) Patent No.: US 8,864,544 B2
(45) Date of Patent: Oct. 21, 2014

(54) HOODED BLANKET AND STUFFED TOY COMBINATION

(75) Inventors: Geoff Anderman, Rogers, AR (US); Doug Keller, Rogers, AR (US)

(73) Assignee: Infinity Headwear & Apparel, LLC, Rogers, AR (US)

( * ) Notice: Subject to any disclaimer, the term of this patent is extended or adjusted under 35 U.S.C. 154(b) by 415 days.

(21) Appl. No.: 13/096,466

(22) Filed: Apr. 28, 2011

(65) Prior Publication Data

US 2012/0276802 A1 Nov. 1, 2012

(51) Int. Cl.

| | |
|---|---|
| ***A63H 3/00*** | (2006.01) |
| ***A47G 9/02*** | (2006.01) |
| ***A41D 11/00*** | (2006.01) |
| ***A63H 3/02*** | (2006.01) |
| *A41D 15/00* | (2006.01) |
| *A47G 9/10* | (2006.01) |

(52) U.S. Cl.

CPC ..... *A63H 3/003* (2013.01); *A63H 3/02* (2013.01); *A41D 15/00* (2013.01); *A47G 9/0223* (2013.01); *A47G 9/1045* (2013.01); *A63H 3/005* (2013.01); *A41D 2200/20* (2013.01)

USPC ..... 446/27; 446/26; 446/71; 446/73; 446/74; 446/76; 446/488; 5/482; 5/485; 2/75; 2/84

(58) Field of Classification Search

CPC ..... A63H 33/00; A63H 3/005; A63H 33/003; A47G 9/1045; A47G 9/0223; A41D 2200/20; A41D 15/00

USPC ..... 446/26, 27, 71, 74, 76, 488, 73; 29/428; 5/482, 485; 2/75, 84

See application file for complete search history.

(56) References Cited

U.S. PATENT DOCUMENTS

| | | | | |
|---|---|---|---|---|
| 4,154,323 | A * | 5/1979 | Sneider | 190/2 |
| 4,543,669 | A * | 10/1985 | Katz | 2/84 |
| 4,590,633 | A * | 5/1986 | Pickens | 5/482 |
| 4,715,840 | A * | 12/1987 | Swift | 446/74 |
| 4,754,512 | A * | 7/1988 | Chao-Yang | 5/482 |
| 4,856,131 | A * | 8/1989 | Mills | 5/413 R |
| 4,928,321 | A * | 5/1990 | Dobson | 2/84 |
| 5,046,980 | A * | 9/1991 | Tai et al. | 446/73 |
| 5,084,930 | A * | 2/1992 | Danova | 5/502 |
| 5,421,045 | A * | 6/1995 | Bowen | 5/485 |
| D445,623 | S * | 7/2001 | Hartner | D6/598 |
| 6,421,852 | B1 * | 7/2002 | Shao | 5/413 R |
| 6,427,267 | B1 * | 8/2002 | Turner | 5/482 |
| 6,434,769 | B1 * | 8/2002 | Koenig | 5/636 |
| 7,367,070 | B2 * | 5/2008 | Akkad | 5/413 R |
| 7,987,536 | B1 * | 8/2011 | Habig et al. | 5/413 R |
| 2001/0044964 | A1 * | 11/2001 | Phillips | 5/485 |
| 2004/0199998 | A1 * | 10/2004 | Shinner | 5/482 |
| 2005/0262634 | A1 * | 12/2005 | Gottlieb | 5/482 |
| 2008/0115254 | A1 * | 5/2008 | Galkov | 2/108 |
| 2008/0182478 | A1 * | 7/2008 | Smoot et al. | 446/72 |
| 2010/0212060 | A1 * | 8/2010 | Whitcomb | 2/75 |

* cited by examiner

*Primary Examiner* — Gene Kim
*Assistant Examiner* — Alexander Niconovich
(74) *Attorney, Agent, or Firm* — David R. Conklin; Kirton McConkie

(57) ABSTRACT

A hooded blanket and stuffed toy combination device that includes a blanket having a perimeter defining an area, a hood attached to the perimeter and positioned externally to the area, and an ornamental surface comprising an outer surface of the hood, wherein the hood comprises an outer shell and an interior volume whereby the blanket is stored within the interior volume of the hood to provide a stuffed toy.

20 Claims, 9 Drawing Sheets

HOODED BLANKET AND STUFFED TOY COMBINATION

BACKGROUND OF THE INVENTION

The present invention relates generally to a hooded blanket and stuffed toy combination. In particular, the present invention relates to a blanket having a hood comprising an ornamental surface, wherein upon stowing the body of the blanket within an interior volume of the hood, a stuffed toy is provided.

It is not uncommon for children to have a favorite toy which they desire to keep with themselves at all times. This is especially true when a child is leaving their home or toys for an extended period of time. The child's toy may provide entertainment and/or comfort to the child while in a foreign environment or in an environment that is not child-friendly. While there are benefits to allowing the child to bring their favorite toy with them, this concession may also provide increased burden to the parent by requiring the parent to transport, and keep track of the toy in addition to other items required by the outing. For example, where the outing is a sporting event or other outdoor activity, a parent may be required to bring a blanket for the child in addition to the child's toy. Thus, while options exist for accommodating the needs of a child during an outing, challenges still exist. Accordingly, it would be an improvement in the art to augment or even replace current techniques with other techniques.

BRIEF SUMMARY OF THE INVENTION

The systems and methods of the present disclosure have been developed in response to problems and needs in the art that have not yet been fully resolved by currently available systems and methods. Thus, the systems and methods herein provide a solution to current challenges within the art.

In some implementations of the present invention a hooded blanket and stuffed toy combination is provided having a blanket with an attached hood, the attached hood having an opening defining an internal cavity, wherein the blanket is stowed into the internal cavity to provide a stuffed toy. The hood further includes an ornamental surface which includes a representation of desired character, theme, or item, such that when the internal cavity is stuffed with the blanket, the ornamental surface becomes the subject matter of the stuffed toy.

In some implementations of the present invention include a method for manufacturing a hooded blanket and stuffed toy combination device, wherein the method includes the steps of providing a blanket, attaching a hood to the blanket, the hood having an opening defining an interior volume, and providing an ornamental surface on a portion of the hood. Some methods of the present invention further include a step of providing one or more pockets on an interior surface of the blanket. Other methods of the present invention further include a step of providing one or more pockets on an exterior surface of the blanket. Some implementations of the present invention include a step for selectively attaching the hood to the blanket. Other implementations of the present invention further include a step for providing a fastener for securing the blanket within the interior volume of the hood. Still further, the method of the present invention includes a step configuring the ornamental surface to include a desired representation, and waterproofing an outer surface of at least one of the hood and the blanket.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. These drawings depict only typical embodiments of the invention and are not therefore to be considered to limit the scope of the invention.

DETAILED DESCRIPTION OF THE INVENTION

Embodiments of the present invention will be best understood by reference to the drawings, wherein like reference numbers indicate identical or functionally similar elements. It will be readily understood that the components of the present invention, as generally described and illustrated in the figures herein, could be arranged and designed in a wide variety of different configurations. Thus, the following more detailed description, as represented in the figures, is not intended to limit the scope of the invention as claimed, but is merely representative of presently preferred embodiments of the invention.

As used herein, the term "blanket" may include a blanket, a comforter, a sheet, a jacket, a windbreaker, a parka, a poncho, a towel, a beach towel, a bath towel, a coat, a wrap, a scarf, a shawl, a cloak, a shirt, a sweatshirt, a hooded shirt and/or a hooded sweatshirt. In general, one having skill in the art will appreciate that the teachings of the present invention may be applied to any piece of clothing or other material compatible with the underlying methodologies and principles disclosed herein.

Figure 1:
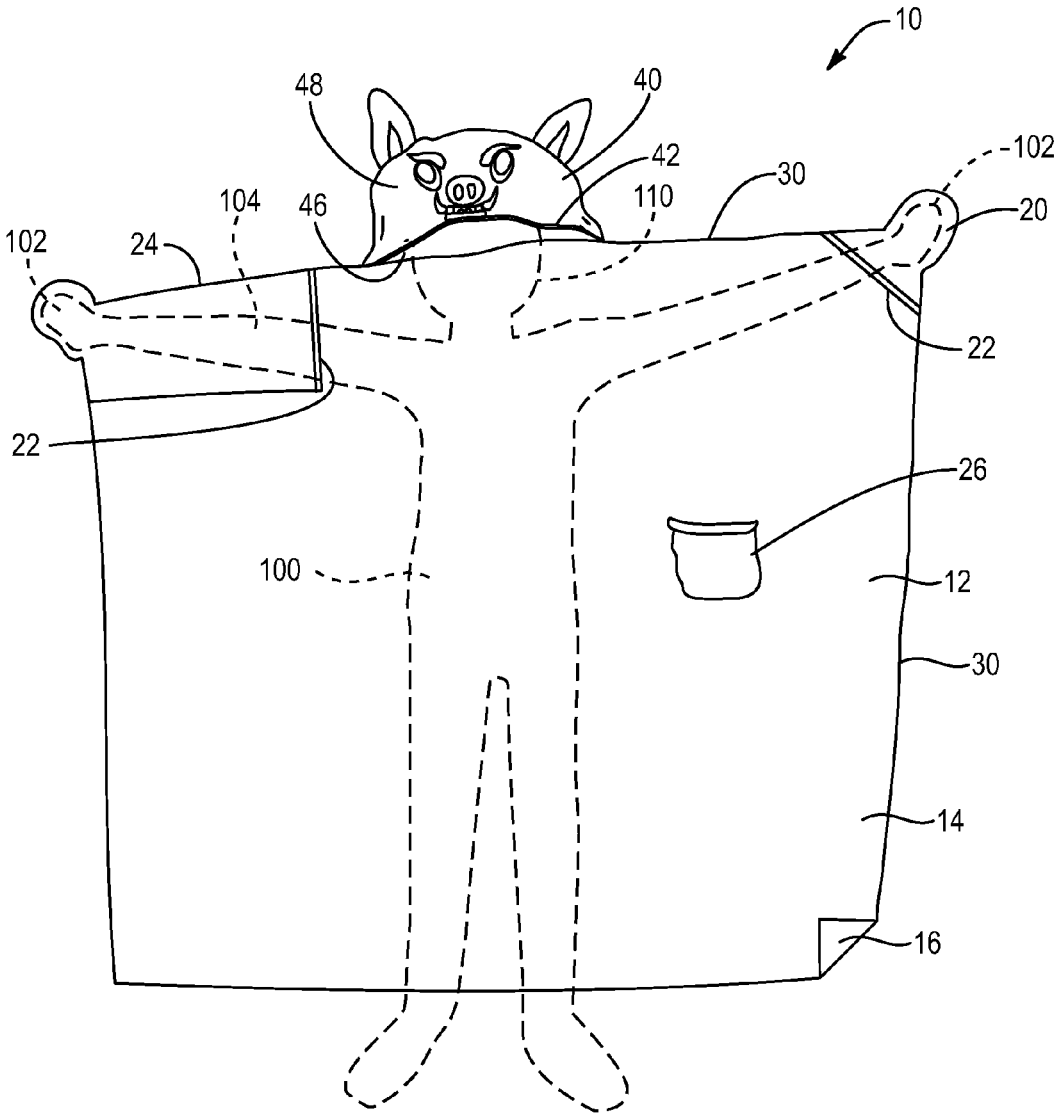
FIG. 1 is a perspective view of a hooded blanket and stuffed toy in accordance with a representative embodiment of the present invention.

Referring now to FIG. 1, a hooded blanket and stuffed toy combination 10 is shown. In general, the hooded blanket and stuffed toy combination of the present invention comprises a blanket 12 having a body that is generally rectangular. However, in some embodiments blanket 12 comprises other geometric shapes, such as square, triangular, octagonal, pentagonal, trapezoidal, and so forth. Blanket 12 further comprises an interior surface 14 and an exterior surface 16, the exterior surface 16 being positioned opposite the interior surface 14.

Blanket 12 may comprise any material compatible for use as a blanket. For example, in some embodiments blanket 12 comprises at material selected from the group of flannel, microfleece, polar fleece, cotton, wool, polyester, jersey knit, plastic, wax cotton, a synthetic, man-made material, a natural fiber material, and the like. In some embodiments, exterior surface 16 comprises a waterproof, waterproof breathable or water resistant material, such as Gortex®. In other embodiments, exterior surface 16 comprises a waterproof coating, such as rubber, polyvinyl chloride, polyurethane, silicone elastomer, fluoropolymers and/or a wax. Still further, in some embodiments exterior surface 16 comprises a windproof or wind resistant material.

Interior surface 14 generally comprises an insulating material. In some embodiments, interior surface 14 comprises a removable insulating material, wherein the insulating capability of blanket 12 may be altered by removing, exchanging, or adding insulating layers to blanket 12.

In some embodiments, blanket 12 further comprises one or more pockets 20, located or positioned in one or more corners of blanket 12. Pockets 20 generally comprise an opening 22 whereby a user 100 may insert their hand or other body part for added comfort and warmth. In some embodiments, opening 22 is capable of being closed thereby forming a pocket in which the user 100 may store valuable items, such as keys or a wallet. In other embodiments, pockets 20 are anatomically shaped so as to accommodate the general shape of the user's hand, or other body part. For example, in some embodiments pocket 20 is shaped and configured to receive the user's hand 102. In other embodiments, pocket 24 is elongated to receive the user's hand and a portion of the user's arm 104. Pocket 24 may further include a second opening (not shown) whereby user's hand 20 is capable of extending out of pocket 24, wherein pocket 24 acts as a sleeve having a second opening positioned opposite the first opening 22. Still further, in some embodiments blanket 12 comprises an interior pocket 26 for storing personal items.

Blanket 12 further comprises a perimeter edge 30 onto which is attached a hood 40. In some embodiments hood 40 is fixedly attached to perimeter edge 30, such as by being sewn together. In other embodiments, hood 40 is selectively or removably attached to perimeter edge 30, such as by a zippered connection, a hook and loop connection (i.e.: Velcro®), a buttoned connection, a snap-button connection, and the like. Thus, in some embodiments the user 100 may use blanket 12 with or without hood 40. In other embodiments, user 100 may exchange hood 40 for a separate hood (not shown) by removing hood 40 from perimeter edge 30 and replacing hood 40 with a desired hood. For example, in some embodiments a non-waterproof hood is replaced with a waterproof hood. In other embodiments a first ornamental hood is replaced with a second ornamental hood.

Hood 40 generally comprises an opening 42 defining an interior volume or interior cavity 46 shaped and configured to receive a portion of the user's head 110. Hood 40 further comprises an ornamental surface 48. In some embodiments, ornamental surface 48 comprises an outer surface of hood 40. In some embodiments, ornamental surface 48 is modified to include a desired representation, such as a team mascot, as shown.

Ornamental surface 48 is generally modified to represent a desired image, item, personality, theme, or object of desire to the user 100. For example, in some embodiments ornamental surface 48 comprises a representation of at least one of a mascot, a fictional character, a non-fictional character, a caricature, a symbol, a crown, an anatomical feature, an inanimate object, a logo, and a food item. In some embodiments, the representation comprises a portion of the ornamental surface 48. In other embodiments, the representation comprises a portion of the ornamental surface 48 and a portion of the interior 14 and/or exterior 16 surfaces of blanket 12.

In some embodiments, the representation is printed or silk-screened onto ornamental surface 48, whereby the representation is two-dimensional. In other embodiments, the representation is three-dimensional. Still further, in some embodiments the representation includes lights, speakers, motors, electronics, animatronics, and other features to enhance the representation as desired by the user.

Figure 2A:
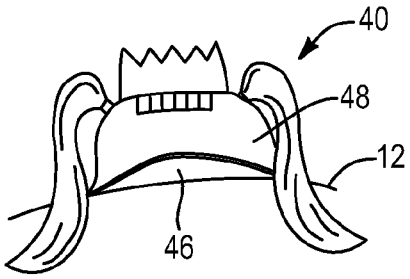
FIGS. 2A-2E are perspective views of various non-limiting embodiments of the ornamental surface of a hood in accordance with the present invention.
Figure 2B:
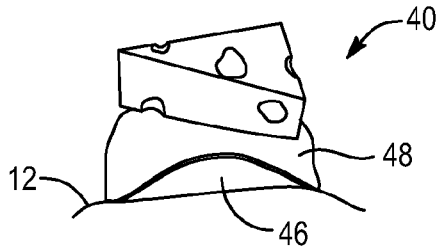
Figure 2C:
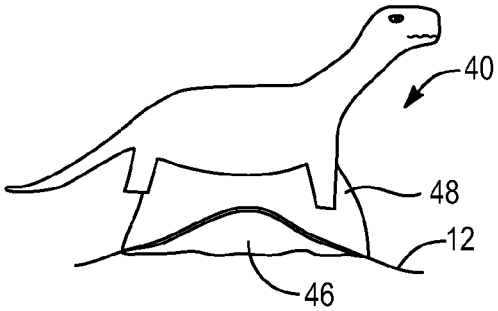
Figure 2D:
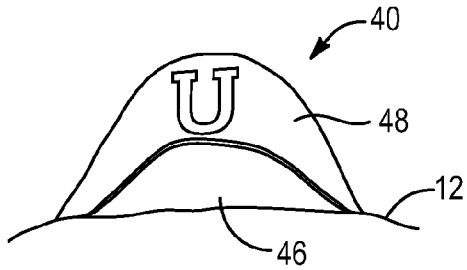
Figure 2E:
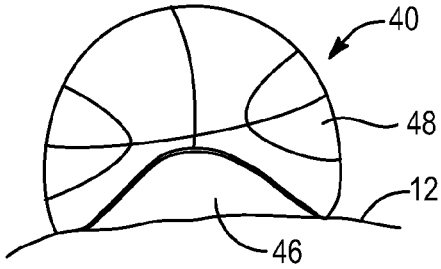

Referring now FIGS. 2A-2E, several non-limiting examples of representations within the teachings of the present invention, are shown. For example, in some embodiments ornamental surface 48 of hood 40 comprises a representation of a princess theme, complete with a crown and faux princess hair, as shown in FIG. 2A. In other embodiments, ornamental surface 48 comprises a food item, such as a wedge of cheese, as shown in FIG. 2B. Further, in some embodiments ornamental surface 48 comprises a stuffed or partially stuffed toy, figurine or other item, as shown in FIG. 2C. Still further, in some embodiments ornamental surface 48 comprises a logo or insignia, as shown in FIG. 2D. In other embodiments, ornamental surface 48 comprises item or object, such as piece or sporting equipment, like a basketball, as shown in FIG. 2E.

Hood 40 and blanket 12 are combined to provide a stuffed toy, wherein the representation comprising ornamental surface 48 is the theme of subject matter of the stuffed toy. The process for forming the stuffed toy is accomplished by stuffing or storing blanket 12 within interior volume 46 of hood 40, wherein blanket 12 becomes the stuffing material, and hood 40 becomes an outer shell of the stuffed toy. In some embodiments, blanket 12 is stuffed into interior volume 46 in an unorganized manner. In other embodiments, blanket 12 is sequentially folded and rolled prior to being stowed in interior volume 46. A non-limiting example of steps to form the stuffed toy is shown in FIGS. 3-8.

Figure 3:
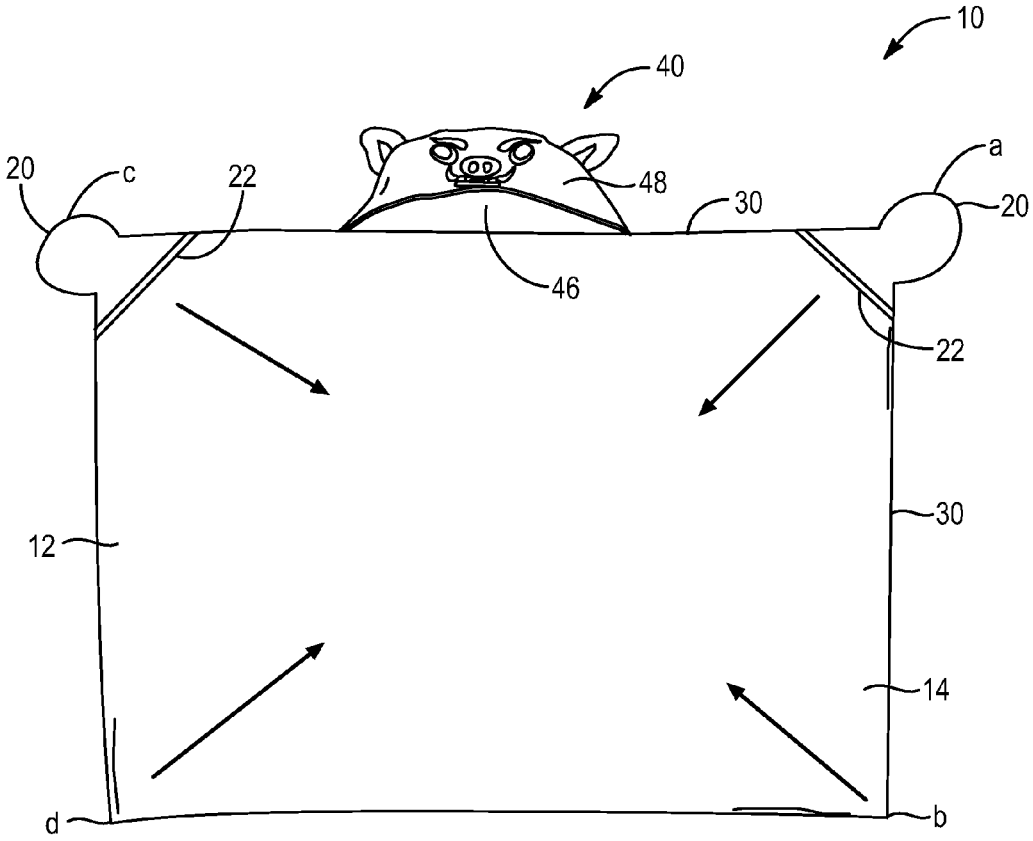
FIG. 3 is a perspective view of a hooded blanket prior to being formed into a stuffed toy in accordance with a representative embodiment of the present invention.
Figure 4:
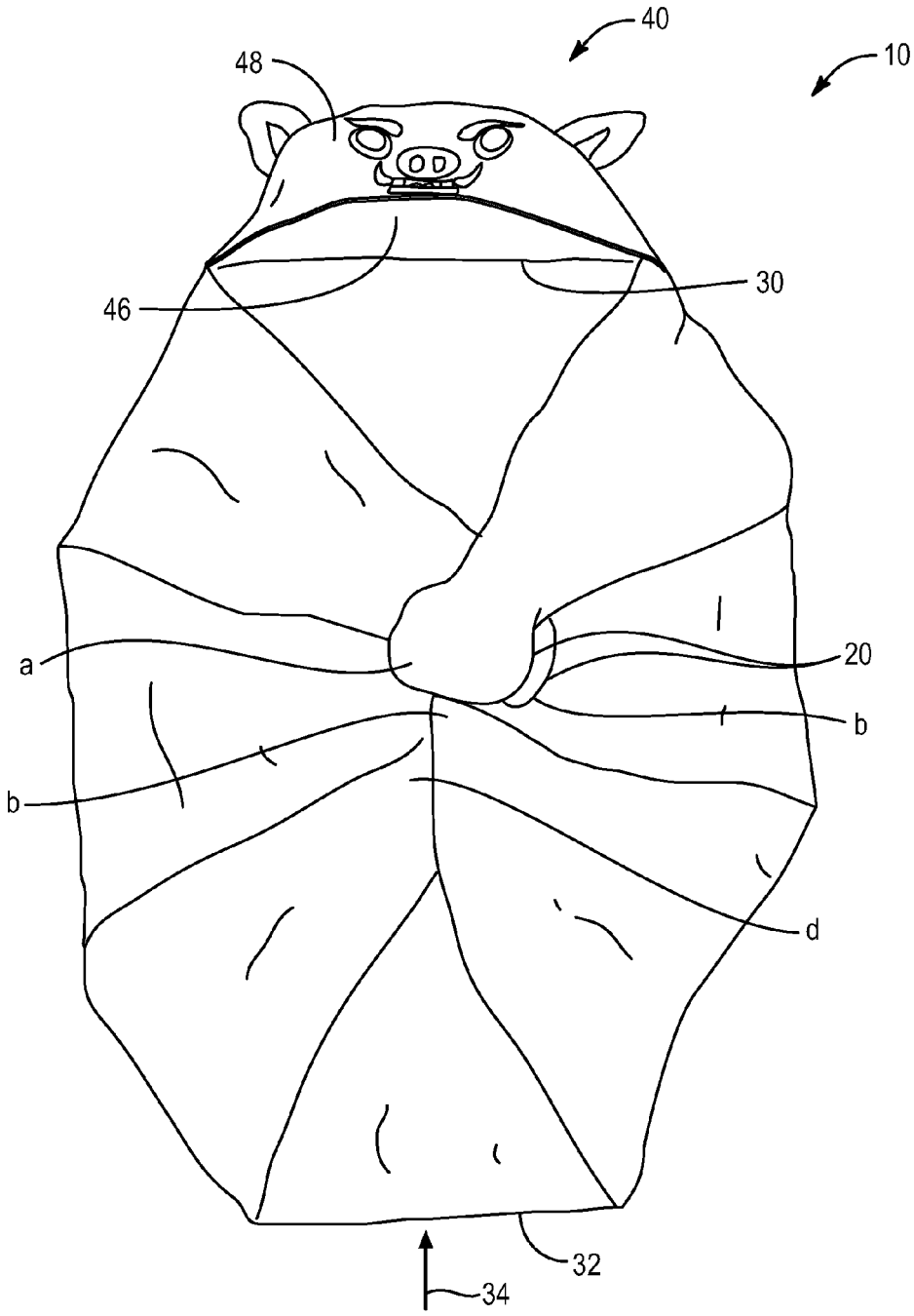
FIG. 4 is a perspective view of a hooded blanket following a first step of forming the hooded blanket into a stuffed toy in accordance with a representative embodiment of the present invention.
Figure 5:
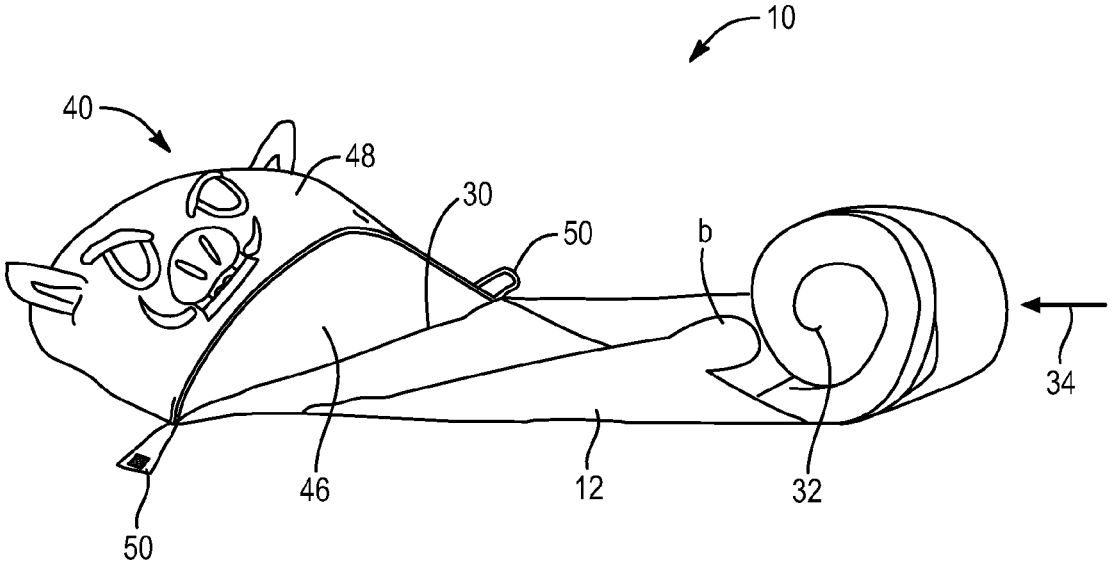
FIG. 5 is a perspective side view of a hooded blanket following a second step of forming the hooded blanket into a stuffed toy in accordance with a representative embodiment of the present invention.
Figure 7:
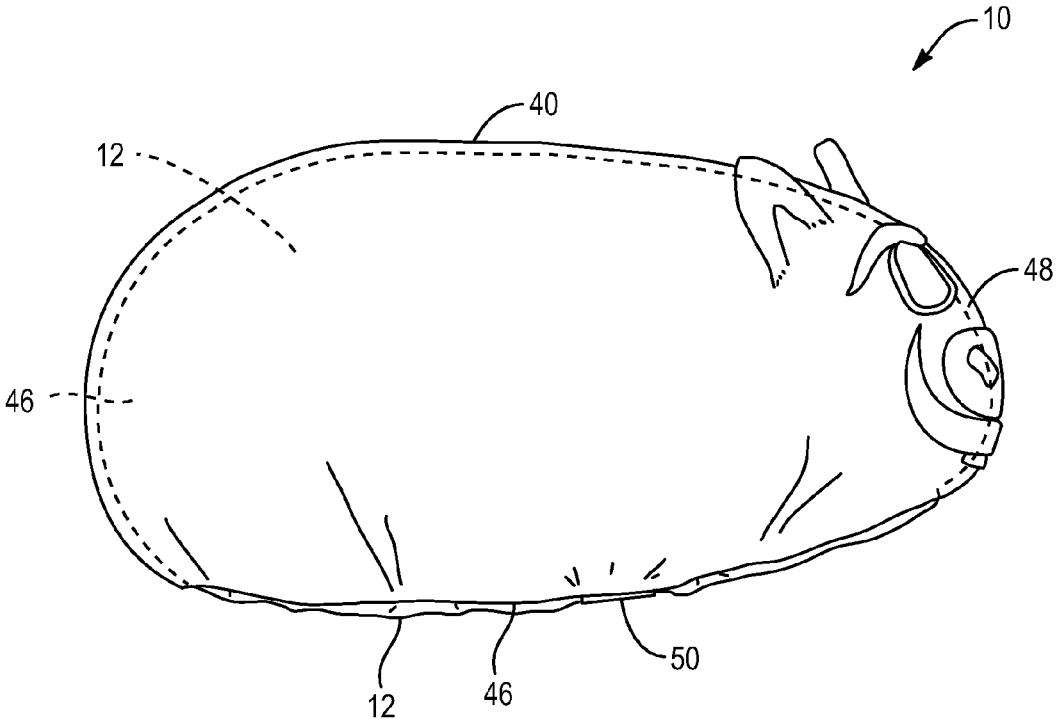
FIG. 7 is a perspective side view of a stuffed toy in accordance with a representative embodiment of the present invention.
Figure 8:
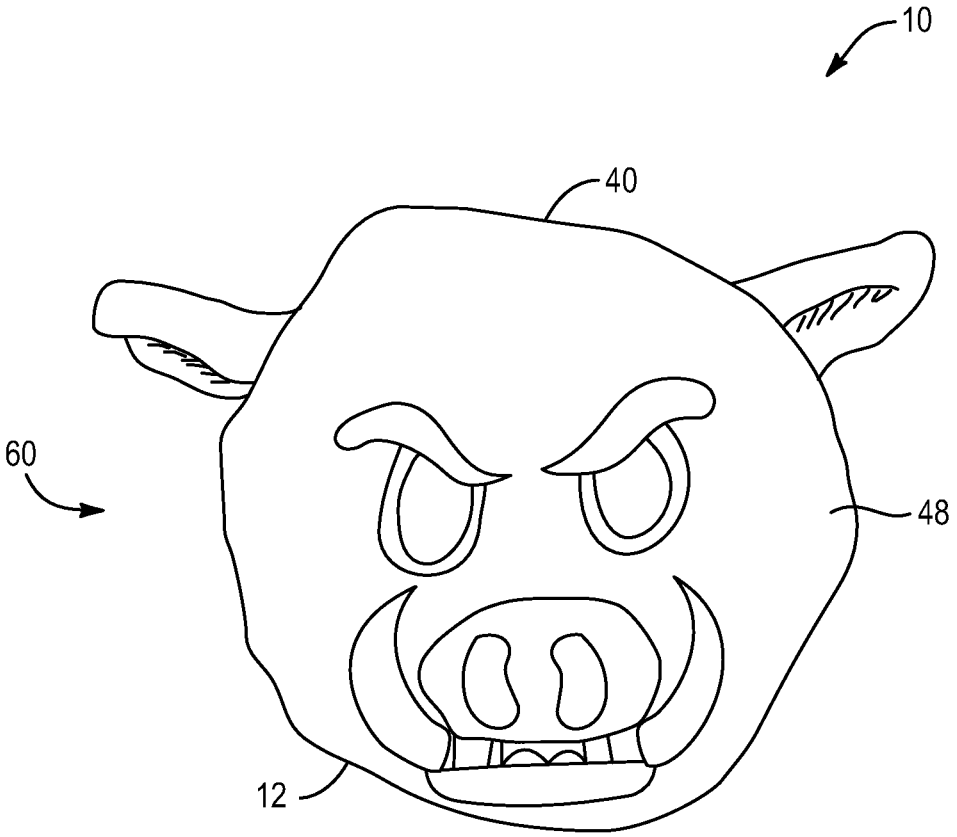
FIG. 8 is a perspective front view of a stuffed toy in accordance with a representative embodiment of the present invention.

Referring now to FIG. 3, the hooded blanket and stuffed toy combination 10 is firstly laid flat or held in a flat position, as shown. The corners a, b, c and d of blanket 12 are then folded inwardly towards the center of blanket 12, as shown in FIG. 4. A distal end 32 of blanket 12 is then rolled in a proximal direction 34 towards hood 40, as shown in FIG. 5. When the rolled blanket 12 reaches internal volume 46, the rolled portion of blanket 12 is inserted or stowed into internal volume 46 and secured via fastener 50, as shown in FIGS. 6-8.

Figure 6:
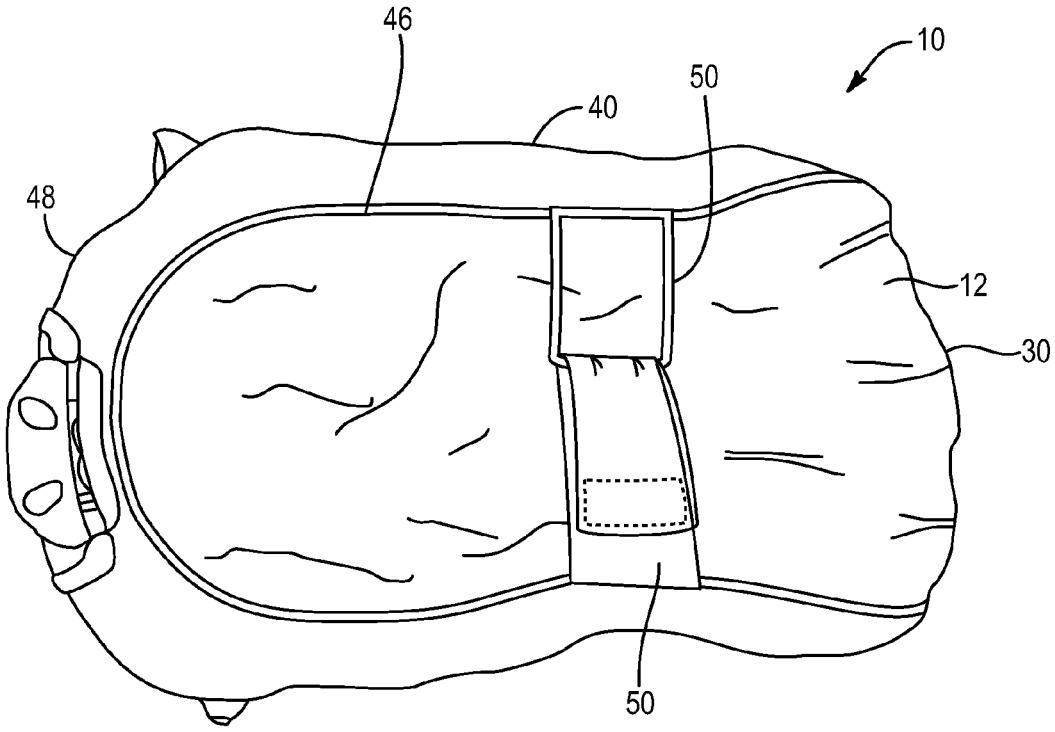
FIG. 6 is a perspective bottom view of a hooded blanket following a third step of forming the hooded blanket into a stuffed toy, wherein the blanket is fastened within the hood to provide a stuffed toy in accordance with a representative embodiment of the present invention.

Referring now to FIG. 6, fastener 50 may include any means whereby to retain blanket 12 within internal volume 46. For example, in some embodiments fastener 50 is comprises at least one of a button and loop closure, a button and buttonhole closure, a hook and loop closure, a strap closure, a tie closure, a zipper closure, a snap closure, and combinations thereof. In some embodiments an enclosure 50 is selected that is easily accessible and set by a child.

Once fastener 50 is set, stuffed toy 60 is provided. In some embodiments, stuffed toy 60 comprises a plush animal or character. In other embodiments, stuffed toy 60 comprises a pillow. Further, in some embodiments stuffed toy 60 comprises a functional item, such as a ball.

Figure 9:
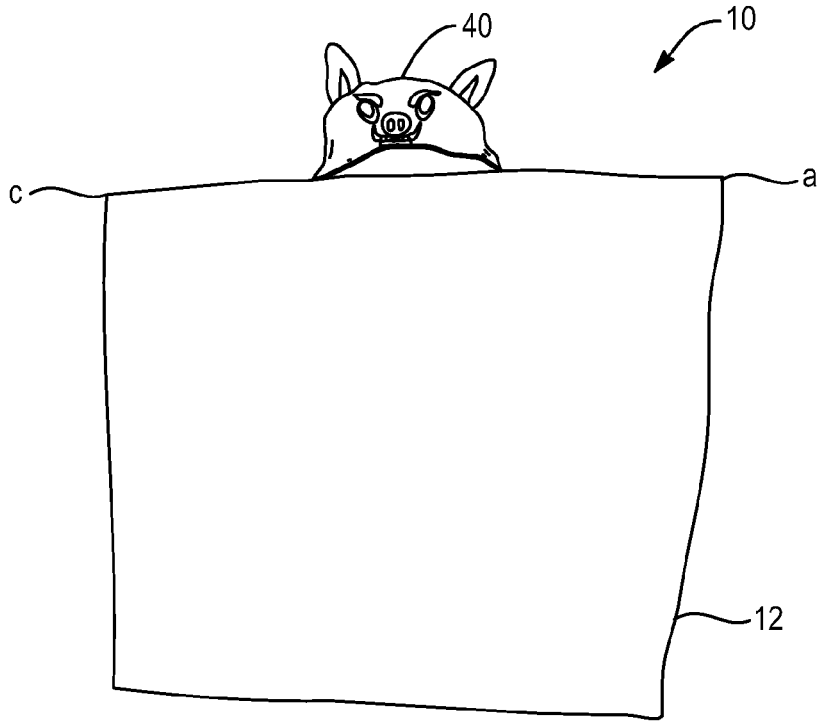
FIG. 9 is a perspective view of a hooded blanket in accordance with a representative embodiment of the present invention.
Figure 10:
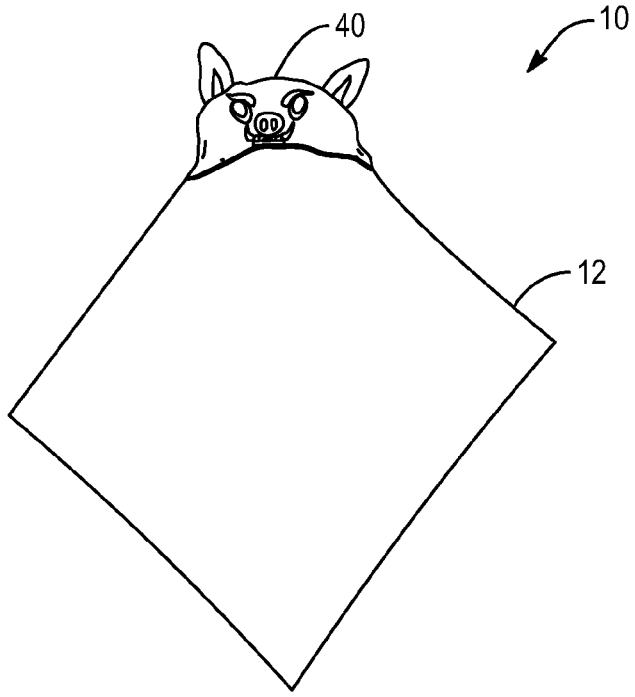
FIG. 10 is a perspective view of a hooded blanket in accordance with a representative embodiment of the present invention.

With reference to FIG. 9, in some embodiments a hooded blanket and stuffed toy combination 10 is provided having no internal or external pockets. In some embodiments, hood 40 is approximately centered between opposing corners a and c of blanket 12. In other embodiments, hood 40 comprises a corner of blanket 12, as shown in FIG. 10.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A hooded blanket and stuffed toy combination comprising:

a blanket having a perimeter defining an area;

a hood attached to the perimeter and positioned externally to the area, the attached hood having an outer surface, an inner surface, and an edge surface interposed therebetween, the edge surface forming a continuous edge surface and defining an opening of the hood, the edge surface comprising an attached surface coupled to the perimeter of the blanket and a detached surface, the inner and edge surfaces of the hood further defining an interior volume of the hood; and an ornamental surface comprising the outer surface, the blanket being stored within the interior volume to provide a stuffed toy.

2. The hooded blanket and stuffed toy combination of claim 1, wherein the hood comprises an outer shell of the stuffed toy, and the blanket stored within the interior volume is a stuffing material for the outer shell of the stuffed toy.

3. The hooded blanket and stuffed toy combination of claim 1, wherein the blanket further comprises an interior surface, the interior surface having at least one pocket.

4. The hooded blanket and stuffed toy combination of claim 3, wherein the at least one pocket defines a corner of the blanket.

5. The hooded blanket and stuffed toy combination of claim 1, wherein the hood is selectively attached to the perimeter of the blanket.

6. The hooded blanket and stuffed toy combination of claim 1, further comprising a fastener for securing the blanket within the interior volume.

7. The hooded blanket and stuffed toy combination of claim 1, wherein the blanket comprises a bath towel.

8. The hooded blanket and stuffed toy combination of claim 1, wherein the ornamental surface comprises a representation of at least one of a mascot, a fictional character, a non-fictional character, a caricature, a symbol, a crown, an anatomical feature, an inanimate object, a logo, and a food item.

9. The hooded blanket and stuffed toy combination of claim 1, wherein at least one of the blanket and the hood further comprises an exterior surface comprising a waterproof material.

10. A method for manufacturing a hooded blanket and stuffed toy combination device, the method comprising the steps of:

providing a blanket comprising a perimeter defining an area;

attaching a hood to the perimeter of the blanket and positioned externally to the area, the hood having an outer surface, an inner surface, and an edge surface interposed therebetween, the edge surface forming a continuous edge surface and defining an opening of the hood, the edge surface comprising an attached surface coupled to the perimeter of the blanket and a detached surface, the inner and edge surfaces of the hood further defining an interior volume of the hood; and providing an ornamental surface on a portion of the hood and comprising the outer surface.

11. The method of claim 10, wherein the hood comprises an outer shell of the stuffed toy, and the blanket stored within the interior volume is a stuffing material for the outer shell of the stuffed toy.

12. The method of claim 10, further comprising providing at least one pocket on an interior surface of the blanket.

13. The method of claim 12, wherein the at least one pocket defines a corner of the blanket.

14. The method of claim 10, further comprising selectively attaching the hood to the perimeter of the blanket.

15. The method of claim 10, further comprising providing a fastener for securing the blanket within the interior volume.

16. The method of claim 10, further comprising configuring the ornamental surface to include a representation of at least one of a mascot, a fictional character, a non-fictional character, a caricature, a symbol, a crown, an anatomical feature, an inanimate object, a logo, and a food item.

17. The method of claim 10, further comprising waterproofing the outer surface of the hood and an exterior surface of the blanket.

18. A blanket, comprising:

a body having an interior surface, an exterior surface, a first edge comprising a first corner and a second corner, and a perimeter edge comprising the first edge and defining an area;

a hood attached to the first edge at a position approximately centered between the first and second corners and positioned externally to the area, the hood having an outer surface, an inner surface, and an edge surface interposed therebetween, the edge surface forming a continuous edge surface and defining an opening of the hood, the edge surface comprising an attached surface coupled to the perimeter of the blanket and a detached surface, the inner and edge surface of the hood further defining an interior volume of the hood, the hood further having an ornamental surface comprising a representation of at least one of a mascot, a fictional character, a non-fictional character, a caricature, a symbol, a crown, an anatomical feature, an inanimate object, a logo, and a food item; and a fastener for securing the body within the interior volume of the hood to provide a stuffed toy.

19. The blanket of claim 18, wherein the fastener comprises at least one of a button and loop closure, a hook and loop closure, a strap closure, a tie closure, a zipper closure, and a snap closure.

20. The blanket of claim 18, wherein the representation is three-dimensional.

* * * * *